US006290108B1

(12) United States Patent
Gross

(10) Patent No.: US 6,290,108 B1
(45) Date of Patent: Sep. 18, 2001

(54) DISPENSING SYSTEM WITH AN INTERNAL RELEASABLE SHIPPING SEAL AND AN EXTENDED TIP CONTAINING A PRESSURE OPENABLE VALVE

(75) Inventor: Richard A. Gross, Oconomowoc, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 09/550,279

(22) Filed: Apr. 14, 2000

(51) Int. Cl.[7] ..... B65D 35/00

(52) U.S. Cl. ..... 222/494; 222/212; 222/490; 222/492; 222/547

(58) Field of Search ..... 222/212, 213, 222/490–494, 519, 520, 523, 525, 545–547

(56) References Cited

U.S. PATENT DOCUMENTS

| | | | |
|---|---|---|---|
| 3,273,754 | 9/1966 | Lindley . | |
| 4,133,457 | 1/1979 | Klassen . | |
| 4,186,882 | 2/1980 | Szczepanski . | |
| 4,253,588 | 3/1981 | Lester et al. . | |
| 4,349,134 | 9/1982 | Schuster et al. . | |
| 4,408,702 | 10/1983 | Horvath . | |
| 4,506,809 | 3/1985 | Corsette . | |
| 4,561,570 | 12/1985 | Zulauf et al. . | |
| 4,635,826 | 1/1987 | Hatakeyama et al. . | |
| 4,690,304 | 9/1987 | Morel . | |
| 4,739,906 | 4/1988 | Lo Turco . | |
| 4,747,518 | 5/1988 | Laauwe . | |
| 4,785,978 | 11/1988 | Kano et al. . | |
| 4,941,598 * | 7/1990 | Lamblet, Jr. et al. | 222/490 |
| 5,033,655 | 7/1991 | Brown . | |
| 5,125,539 | 6/1992 | Schneider . | |
| 5,143,236 | 9/1992 | Gueret . | |
| 5,226,568 | 7/1993 | Newton et al. . | |
| 5,267,673 | 12/1993 | Crosnier et al. . | |
| 5,295,597 | 3/1994 | Green . | |
| 5,325,999 | 7/1994 | Gueret . | |
| 5,680,969 | 10/1997 | Gross . | |
| 5,692,651 | 12/1997 | Fuchs . | |
| 5,743,443 | 4/1998 | Hins . | |
| 5,782,386 | 7/1998 | Lester . | |

(List continued on next page.)

OTHER PUBLICATIONS

U.S. Patent application Ser. No. 09/157,706, filed Sep. 21, 1998.

U.S. Patent application Ser. No. 09/352,172, filed Jul. 12, 1999.

U.S. Patent Application of inventors Richard A. Gross, Daniel G. Schantz, and Timothy R. Socier, entitled "Package With Multiple Chambers and Valves".

*Primary Examiner*—J. Casimer Jacyna
(74) *Attorney, Agent, or Firm*—Rockey, Milnamow & Katz, Ltd.

(57) ABSTRACT

A dispensing system is provided for dispensing a product from a container having an opening. The dispensing system includes a spout for communicating with the container opening. The spout defines at least one discharge aperture, a distal seal surface located distally of the discharge aperture, and a proximal seal surface located on the exterior of the spout proximally of the discharge aperture. A nozzle assembly is mounted on the spout for movement between a retracted, closed position and an extended, open position. The nozzle assembly includes a nozzle having a dispensing passage around at least a portion of the spout, a proximal seal surface for sealingly engaging the spout proximal surface, and a distal seal surface located outwardly of the nozzle proximal seal surface for sealingly engaging the spout distal seal surface when the nozzle assembly is in the retracted, closed position. The nozzle assembly also includes a resiliently flexible valve that is sealingly disposed across the nozzle dispensing passage at a location distally of the spout distal seal surface and has an initially closed dispensing orifice which opens in response to a pressure differential acting across the valve.

40 Claims, 11 Drawing Sheets

U.S. PATENT DOCUMENTS 5,803,314 9/1998 Lester .
5,839,626 11/1998 Gross et al. .
5,897,033 4/1999 Okawa et al. .
5,934,514 8/1999 Lampe et al. .
5,938,086 8/1999 Gross ..... 222/494
5,950,878 9/1999 Wade et al. .

* cited by examiner

DISPENSING SYSTEM WITH AN INTERNAL RELEASABLE SHIPPING SEAL AND AN EXTENDED TIP CONTAINING A PRESSURE OPENABLE VALVE

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a system for dispensing a product from a container. The system is especially suitable for use as part of, or as a dispensing closure for, a flexible container which is squeezable.

BACKGROUND OF THE INVENTION AND TECHNICAL PROBLEMS POSED BY THE PRIOR ART

There are a wide variety of packages which include (1) a squeezable container, (2) a dispensing system extending as a unitary part of, or attachment to, the container, and (3) a product contained within the container. One type of such a package employs a single dispensing valve for discharging a single stream of product (which may be a liquid, cream, or particulate product). See, for example, U.S. Pat. No. 5,839,614. The package includes a flexible, resilient, slit-type valve. The valve is normally closed and can withstand the weight of the product when the container is completely inverted, so that the product will not leak out unless the container is squeezed.

With some types of products, such as glue, hair coloring, condiments, and the like, it may be desirable to provide a dispensing system which can more accurately control the discharge of the product. In particular, it may be desirable to more precisely control the location of the deposit of the product and to provide a dispensing system for affording such control while at the same time permitting the user to clearly observe the product deposition location. It would also be advantageous if such an improved dispensing system could also more accurately control the direction in which the product is dispensed while at the same time providing a clear indication to the user as to the specific direction in which the product will be, or is being, dispensed.

Although a relatively long, narrow, tapered nozzle might be employed to facilitate the dispensing of a product in a way that would enable the user to more accurately control the product dispensing location and product dispensing direction, the use of such a long nozzle can create other problems. Specifically, the product within a long nozzle may continue to flow from the nozzle even after the desired amount of product has been dispensed.

For example, consider the situation when a relatively high viscosity product is being dispensed from an inverted, squeezable container through a relatively long nozzle. The long nozzle must be initially filled with fluid product as the container is inverted. The user, after inverting the container, is unable to tell exactly when the product will be discharged from the tip of the nozzle. With a relatively high viscosity product, the user will have to squeeze the container somewhat just to fill the nozzle, and the user thus cannot be sure when the nozzle has been filled and when the first drop of product will be discharging from the nozzle.

Further, when the user sees that the desired amount of product has been dispensed from the tip of the nozzle and deposited on the receiving surface, the user would typically stop squeezing the container. However, the amount of product within the nozzle may continue to flow out of the nozzle before the user can invert the container or otherwise move the system away from the dispensing location. Thus, such a system lacks the desired capability to precisely control the termination of the product flow from the nozzle.

Accordingly, it would be desirable to provide an improved dispensing system which could overcome, or at least minimize, the above-described product dispensing control problems.

It would also be desirable to provide an internal system for positively preventing flow of the product through the system regardless of the orientation of the container and regardless of whether or not the container was being squeezed or otherwise pressurized. Such an internal seal system should be easily actuatable to open the flow path when desired to accommodate the dispensing of the product and should be readily actuatable to close the flow path when desired so as to prevent inadvertent leakage of the product when the container is being shipped or stored where it might be subjected to external impact forces which could increase the pressure within the container or otherwise cause discharge of some amount of the product.

It would also be beneficial if an improved dispensing system could function without the need for a hinged lid which would have to be initially moved to an open position to permit dispensing and which, in the open position, could obscure a portion of the product dispensing stream or product discharge location from the user's view. It would also be desirable if such an improved dispensing system would not employ any other type of separate lid, overcap, or plug which would require removal prior to dispensing and which could become lost or misplaced.

It would also be advantageous if such an improved system could accommodate bottles, containers, or packages which have a variety of shapes and that are constructed from a variety of materials.

Further, it would be desirable if such an improved system could accommodate efficient, high-quality, large-volume manufacturing techniques with a reduced product reject rate to produce a system with consistent operating characteristics.

The present invention provides an improved dispensing system which can accommodate designs having the above-discussed benefits and features.

BRIEF SUMMARY OF THE INVENTION

The present invention provides a system for dispensing a product from a container in a way that can be better controlled by the user. The system can accommodate the discharge of liquids, creams, or particulate matter, including powders. The user can more easily ascertain the location where the product will be deposited. The user can readily control the direction of product flow. Further, the starting and stopping of the product flow can be more precisely controlled.

The dispensing system is adapted for use in dispensing a product from a container having an opening. The dispensing system may be formed as a unitary part of an end of such a container, or the system may be a separate assembly that is permanently or releasably attached to the container.

The dispensing system includes a spout for communicating with the container opening. The dispensing system defines (1) at least one aperture, (2) a distal seal surface located distally of the discharge aperture, and (3) a proximal seal surface located on the exterior of the spout proximally of the discharge aperture.

The dispensing system includes a nozzle assembly which is mounted on the spout. The nozzle assembly is movable along the spout between a retracted, closed position, and an extended, open position. The nozzle assembly includes a nozzle having (1) a dispensing passage around at least a portion of the spout, (2) a proximal seal surface for sealingly engaging the spout proximal seal surface, and (3) a distal seal surface located outwardly of the nozzle proximal seal surface for sealingly engaging the spout distal seal surface when the nozzle assembly is in the retracted, closed position.

The nozzle assembly also includes a resiliently flexible valve. The valve is sealingly disposed across the nozzle dispensing passage at a location distally of the spout distal seal surface. The valve has an initially closed dispensing orifice which opens in response to a pressure differential acting across the valve.

A presently preferred form of the dispensing system has the valve mounted adjacent the distal tip of the nozzle. Preferably, the valve is selfsealing and is biased to close when the pressure differential across the open valve drops below a predetermined amount. Alternatively, the dispensing system can employ a valve which, once opened, remains opened even if the pressure differential across the valve drops to zero. Further, the dispensing structure of the present invention can accommodate different types of valves, as well as different sizes of valves.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show the dispensing system in the typical orientation that it would have at the top of a container when the container is stored upright on its base, and terms such as upper, lower, horizontal, etc., are used with reference to this position. It will be understood, however, that the dispensing system of this invention may be manufactured, stored, transported, used, and sold in an orientation other than the position described.

The dispensing system of this invention is suitable for use with a variety of conventional or special containers having various designs, the details of which, although not illustrated or described, would be apparent to those having skill in the art and an understanding of such containers. The container per se forms no part of the present invention.

Figure 6:
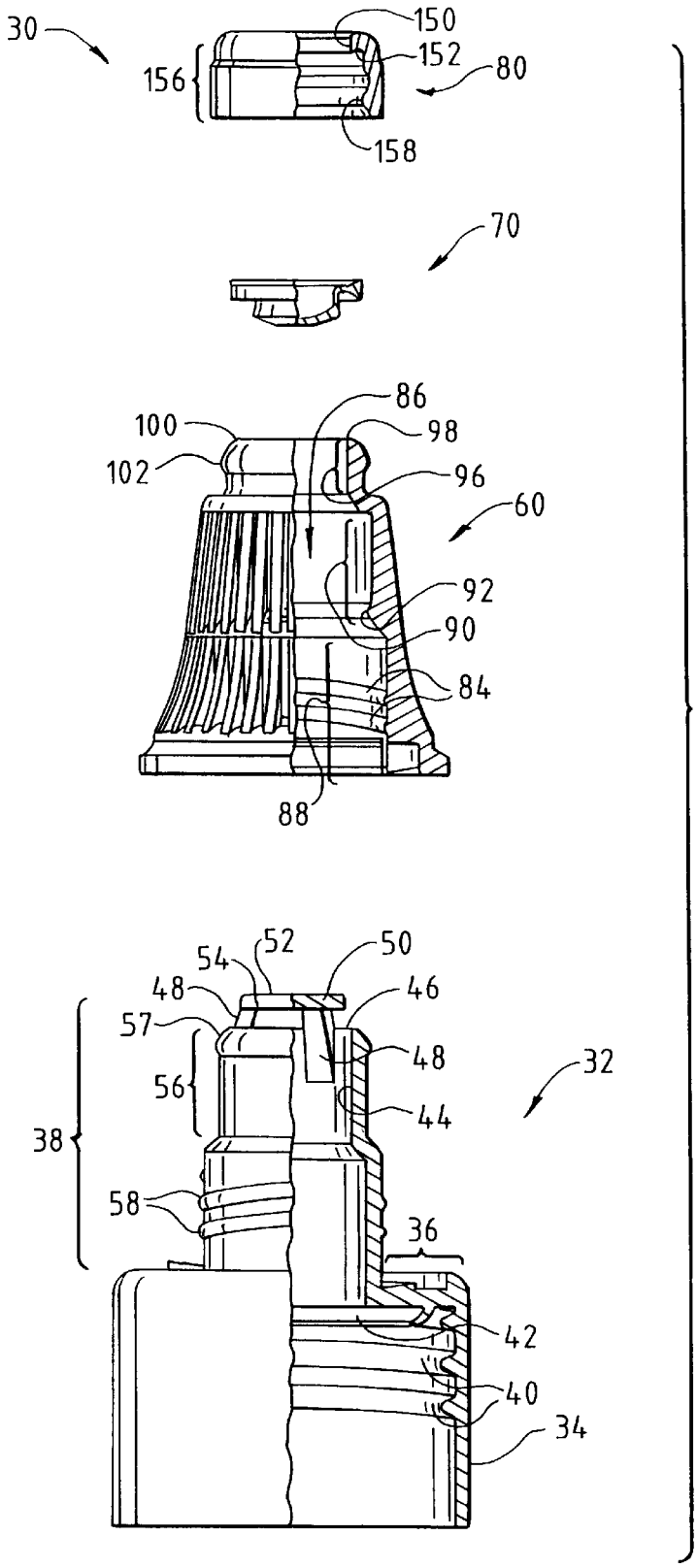
FIG. 6 is an exploded, partial cross-sectional view of the first embodiment.

The first embodiment of the dispensing system of the invention is illustrated in FIGS. 1–11 in the form of a dispensing closure 30 for a container (not illustrated). As can be seen in FIG. 6, the closure 30 has a body 32 which includes a hollow, generally cylindrical base or skirt 34, an annular shoulder 36 extending radially inwardly from the top of the skirt 34, and a reduced diameter spout 38 extending upwardly from the inner portion of the shoulder 36.

As can be seen in FIG. 6, the interior of the skirt 34 defines an internal, female thread 40. The skirt 34 is adapted to receive the upper end of a container mouth or neck (not illustrated). The skirt thread 40 is adapted to matingly engage a thread on the container mouth or neck.

Alternatively, the closure skirt 34 could be provided with some other container connecting means, such as a snap-fit bead or groove (not illustrated) in place of the thread 40 for engaging a mating groove or bead (not illustrated), respectively, in the container neck. The closure body 32 could also be permanently fixed to the container by means of induction melting, ultrasonic melting, gluing, or the like, depending on the materials used for the closure body 32 and the container. The closure body 32 could also be formed as a unitary part, or extension, of the container.

The closure body skirt 34 may have any suitable configuration. The container could have an upwardly projecting neck or other portion for being received within the particular configuration of the closure body 32, and the main part of the container may have a different cross-sectional shape than the container neck and closure body skirt 34.

The closure 30 is adapted to be used with a container having a mouth or other opening to provide access to the container interior and to a product contained therein. The product may be, for example, a liquid comestible product. The product could also be any other liquid, solid, or gaseous material, including, but not limited to, a powder, a cream, a food product, a personal care product, an industrial or household cleaning product, or other chemical compositions (e.g., compositions for use in activities involving manufacturing, commercial or household maintenance, construction, agriculture, etc.).

The container would typically be a squeezable container having a flexible wall or walls which can be grasped by the user and squeezed or compressed to increase the internal pressure within the container so as to force the product out of the container and through the closure 30. The container wall typically has sufficient, inherent resiliency so that when the squeezing forces are removed, the container wall returns to its normal, unstressed shape. Such a squeezable wall structure is preferred in many applications but may not be necessary or preferred in other applications. For example, in some applications it may be desirable to employ a generally rigid container and to pressurize the container interior at selected times with a piston or other pressurizing system.

Figure 1:
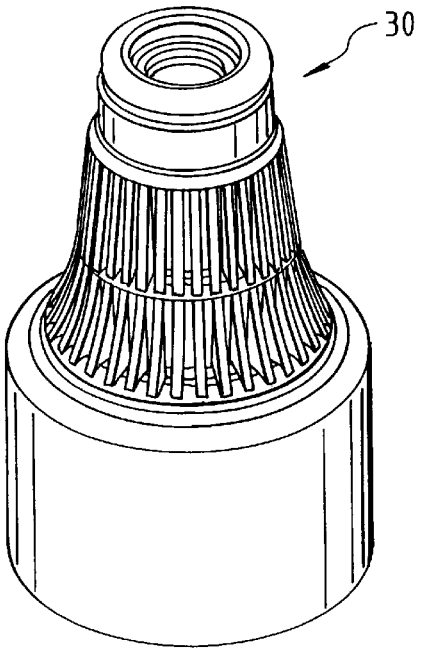
FIG. 1 is a perspective view of a first embodiment of the dispensing system of the present invention incorporated in a dispensing closure which is formed separately from, and which is adapted to be releasably mounted to, a container which has an opening to the container interior, and the dispensing closure is shown with the components in a closed condition.
Figure 2:
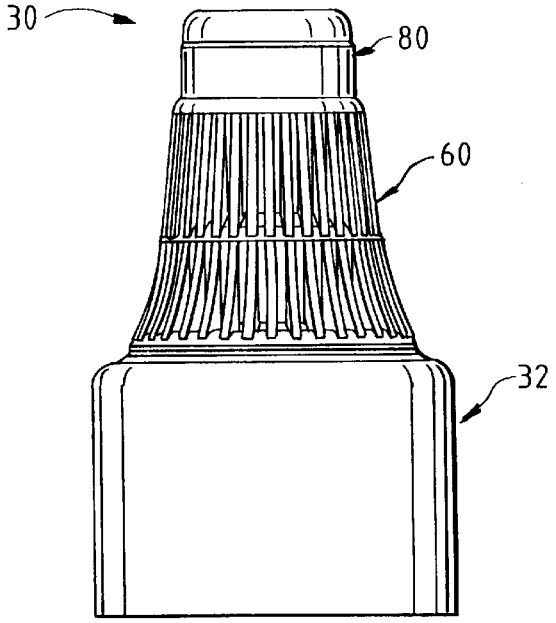
FIG. 2 is a side elevational view of the first embodiment of the closed dispensing closure.
Figure 3:
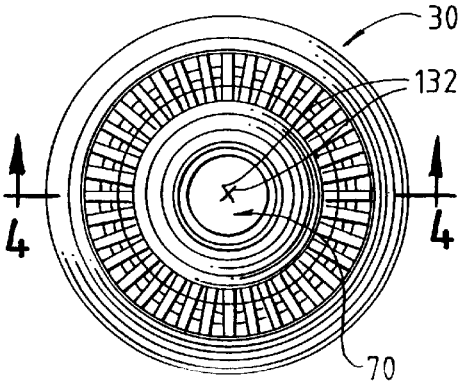
FIG. 3 is a top plan view of the first embodiment of the closed dispensing closure.
Figure 4:
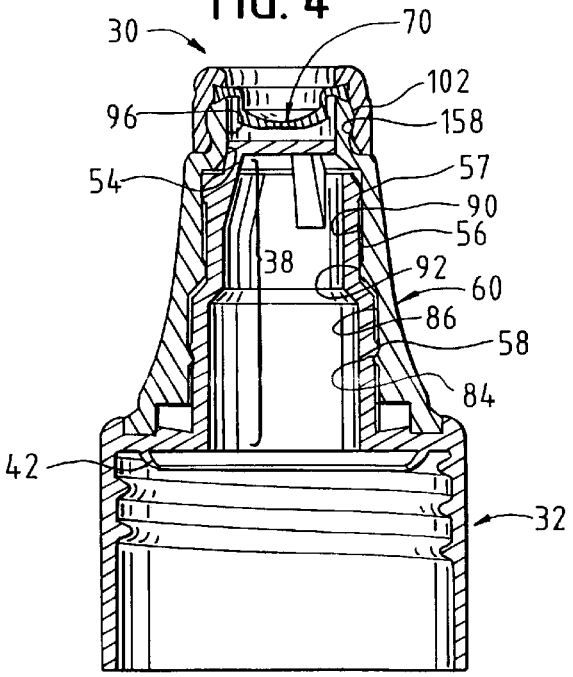
FIG. 4 is a cross-sectional view taken generally along the plane 4—4 in FIG. 3.
Figure 5:
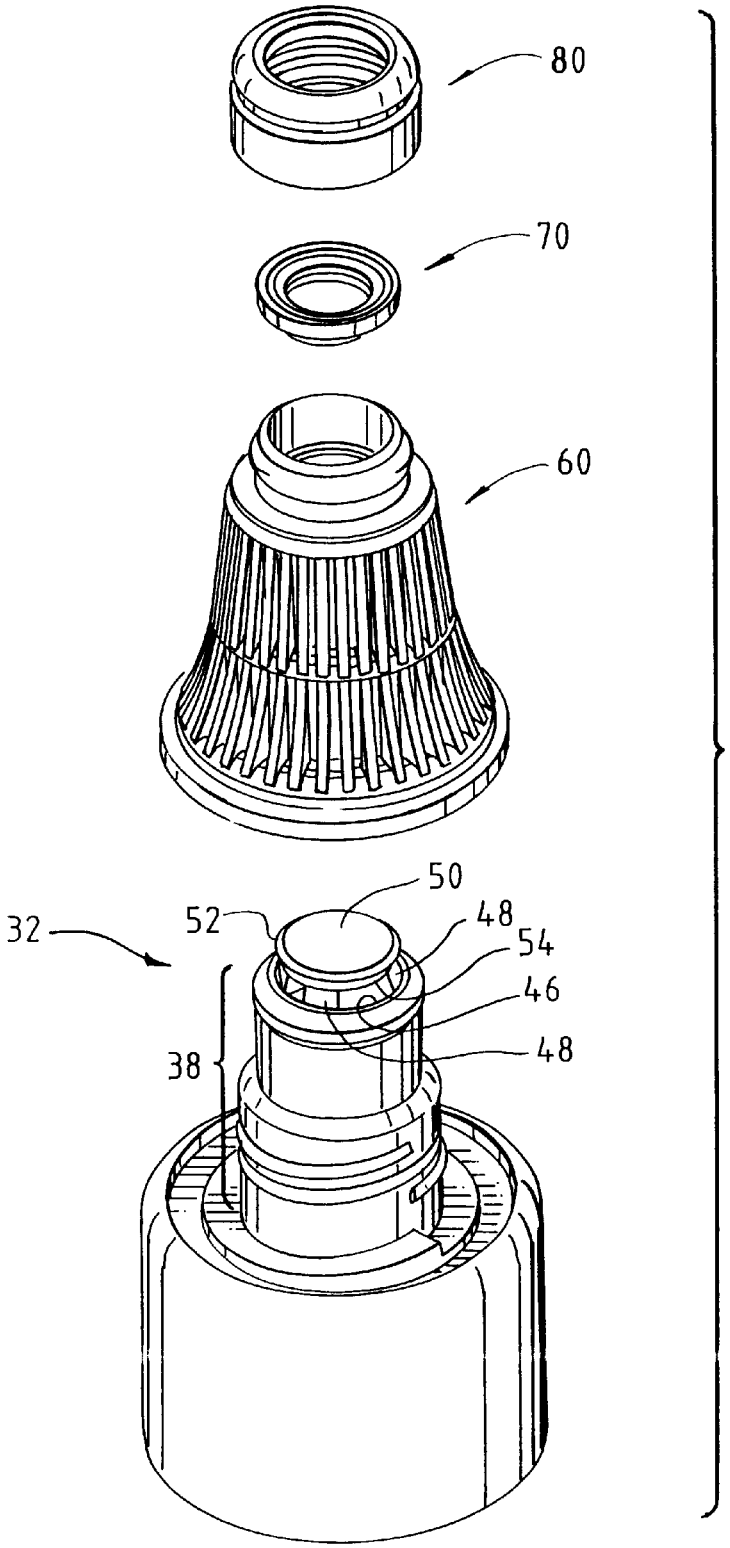
FIG. 5 is an exploded, perspective view of the first embodiment.

An annular, "crab's claw" seal 42 projects downwardly from the underside of the body shoulder 36 as can be seen in FIGS. 4 and 6. The seal 42 is adapted to sealingly engage the upper, annular edge of the container (not illustrated) on which the closure 30 is mounted.

The preferred embodiment of the spout 38 has a generally circular, transverse cross section everywhere along its length, and the diameter of the base 34 is greater than the largest diameter of the spout 38. The spout 38 has an internal discharge passage 44 (FIG. 6) for communicating with the container interior. The spout 38 also has a distal end that includes at least one discharge aperture 46 (FIGS. 5 and 6) that opens externally from the spout discharge passage 44. Preferably, there are three such apertures 46 with a strut 48 between each pair of adjacent apertures 46. Three such struts 48 which are arranged equidistantly around the end of the spout 38. The distal ends of each strut 48 support a disk 50 (FIGS. 5 and 6) located distally of the three apertures 46. The disk 50 has an arcuate, peripheral, distal edge 52 which merges with a generally cylindrical, peripheral surface 54 which functions as a distal seal surface located distally of the discharge apertures 46. The size, shape, and number of apertures 46 and struts 48 may vary. The profile of the disk surfaces 52 and 54 may vary.

The spout 38 also has an exterior, proximal seal surface 56 (FIG. 6) located proximally of the discharge apertures 46. The proximal seal surface 56 is preferably cylindrical. The upper end of the proximal seal surface 56 terminates at the discharge apertures 46 in an annular bead 57 (FIG. 6).

Below the seal surface 56 is an external, male thread 58 (FIG. 6 around the base of the spout 38. Multiple lead threads may be employed. A cam surface could also be employed in place of a thread per se.

The dispensing closure body 32 is preferably molded from a thermoplastic material such as polypropylene to form a generally rigid, hard, plastic structure. The particular material from which the body 32 is molded forms no part of the present invention.

The dispensing closure 30 also includes a nozzle assembly, which in the first embodiment illustrated in FIG. 6, comprises a twist tip or nozzle 60, a valve 70, and a retention cap 80. The nozzle 60 is adapted to be mounted on the spout 38. The nozzle 60 includes an internal, female thread 84 (FIG. 6) for engaging the spout thread 58. If the spout 38 employs a cam instead of the thread 58 per se, then the nozzle 60 would have a suitable cam follower.

Figure 7:
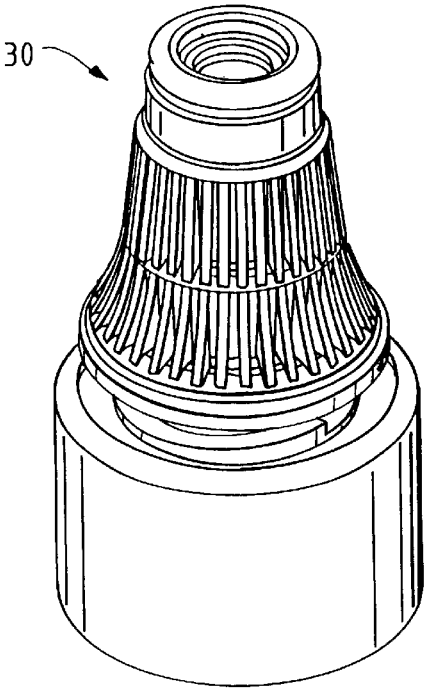
FIG. 7 is a perspective view similar to FIG. 1, but FIG. 7 shows the first embodiment of the dispensing closure in a fully opened condition.
Figure 8:
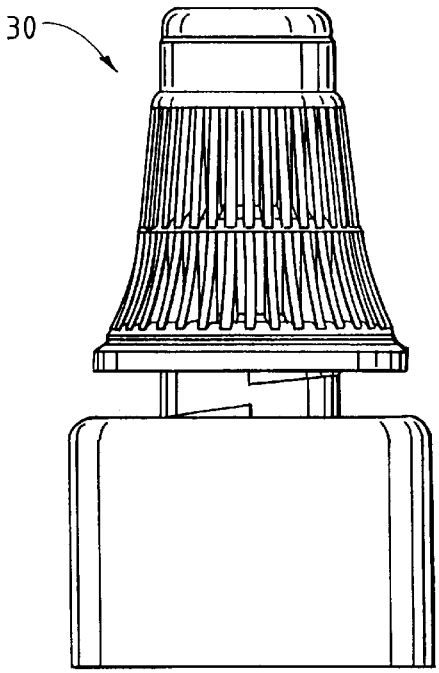
FIG. 8 is a side elevational view of the fully opened dispensing closure shown in FIG. 7.
Figure 9:
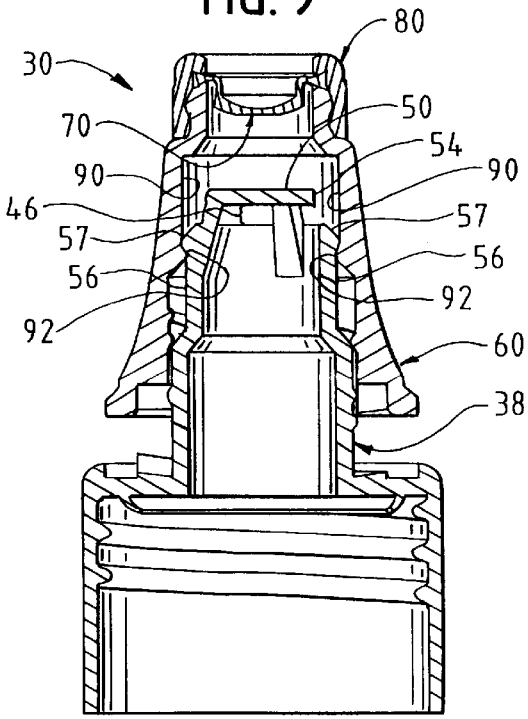
FIG. 9 is a cross-sectional view similar to FIG. 4, but FIG. 9 shows the dispensing closure in the fully opened configuration corresponding to FIGS. 7 and 8.

The inside of the nozzle 60 defines an internal dispensing passage 86 (FIG. 6) which is adapted to receive, and extend around, at least a portion of the spout 38 as shown in FIG. 4. The nozzle 60 can be rotated in threaded engagement on the spout 38 to effect axial movement of the nozzle 60 along the spout 38 between a lowered or retracted, closed position (FIGS. 1, 2, and 4) and an elevated or extended, open position (FIGS. 7–9).

With reference to FIG. 6, the dispensing passage 86 of the nozzle 60 has a larger diameter lower portion 88 containing the thread 84. The nozzle 60 has a reduced diameter intermediate portion defining a proximal seal surface 90. At the bottom of the nozzle proximal seal surface 90 is an annular bead 92 (FIG. 6.

The upper end of the nozzle 60 preferably has a further reduced diameter upper portion defining a generally cylindrical distal seal surface 96 (FIG. 6) located outwardly of the nozzle proximal seal surface 90. The nozzle distal seal surface 96 and nozzle proximal seal surface 90 together define at least part of the nozzle dispensing passage 86.

The nozzle 60 terminates at its upper, distal end in a dispensing opening 98 (FIG. 6). The nozzle 60 defines an annular seat 100 (FIG. 6) around the nozzle dispensing opening. The external surface of the nozzle 60 includes an annular bead 102 (FIG. 6) adjacent the seat 100.

In the preferred embodiment illustrated, the valve 70 has the configuration and operating characteristics of a commercially available valve design substantially as disclosed in the U.S. Pat. No. 5,676,289 with reference to the valve 46 disclosed in the U.S. Pat. No. 5,676,289. The operation of such a type of valve is further described with reference to the similar valve that is designated by reference number 3d in the U.S. Pat. No. 5,409,144. The descriptions of those two patents are incorporated herein by reference thereto to the extent pertinent and to the extent not inconsistent herewith.

Figure 10:
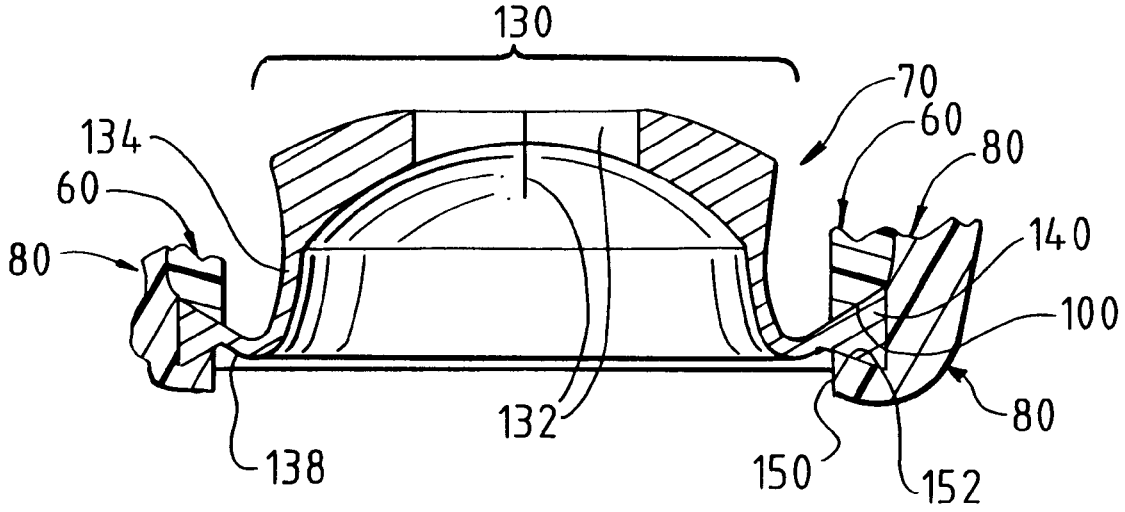
FIG. 10 is a greatly enlarged, fragmentary, cross-sectional view of the distal end of the dispensing closure shown in an inverted orientation prior to dispensing product from the container.
Figure 11:
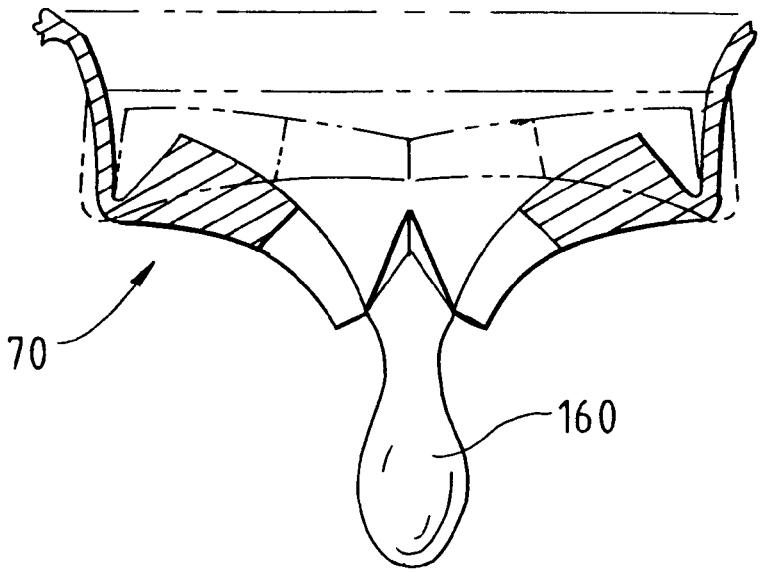
FIG. 11 is a view similar to FIG. 10, but FIG. 11 shows the valve in the distal end of the dispensing closure in a substantially fully opened configuration dispensing a product which is pressurized from the interior region adjacent the valve.
Figure 12:
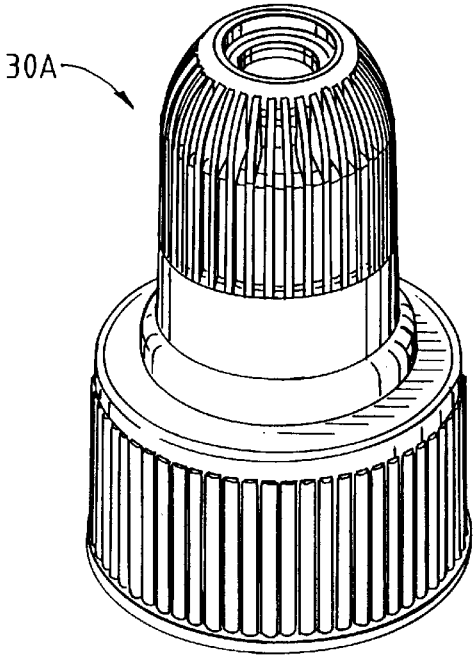
FIG. 12 is a perspective view of a second embodiment of the dispensing system of the present invention incorporated in a dispensing closure which is formed separately from, and which is adapted to be releasably mounted to, a container which has an opening to the container interior, and the dispensing closure is shown with the components in a closed condition.
Figure 13:
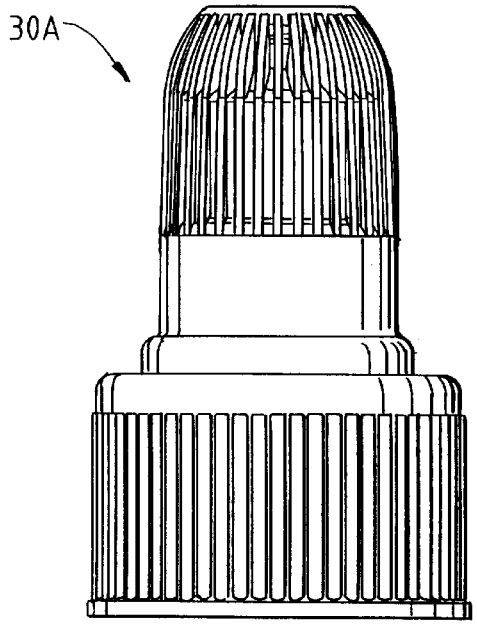
FIG. 13 is a side elevational view of the second embodiment of the dispensing closure in a closed condition.
Figure 14:
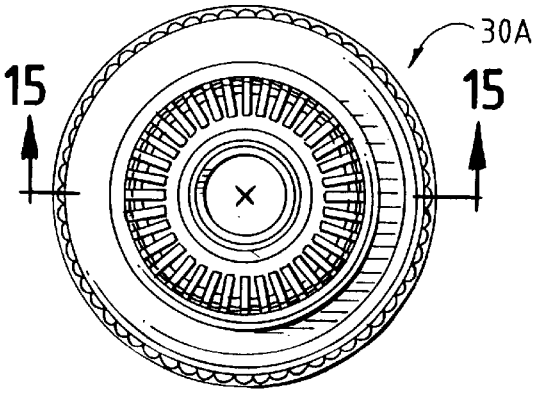
FIG. 14 is a top plan view of the second embodiment of the dispensing closure.

The valve 70 is flexible and changes configuration between (1) a closed, rest position (shown in an upright package in FIG. 9 and shown in an inverted package in FIG. 10) and (2) an active, open position (shown in an inverted package in FIG. 11). The valve 70 includes a flexible, central portion, face, or head portion 130 (FIG. 10) which has an unactuated, concave configuration (when viewed from the exterior) and has two, mutually perpendicular, intersecting, dispensing slits 132 of equal length which together define a closed dispensing orifice. The intersecting slits 132 define four, generally sector-shaped, flaps or petals in the concave, central, head portion 130. The flaps open outwardly from the intersection point of the slits 132, in response to increasing container pressure of sufficient magnitude, in the well-known manner described in the U.S. Pat. No. 5,409,144.

The valve 70 includes a skirt or sleeve 134 which extends from the valve central wall or head portion 130. At the outer end of the sleeve 134, there is a thin, annular flange 138 which extends peripherally from the sleeve 134 in a reverse angled orientation. The thin flange 138 merges with an enlarged, much thicker, peripheral flange 140 which has a generally dovetail shaped, transverse cross section (as viewed in FIG. 10).

To accommodate the seating of the valve 70 in the nozzle 60, the frustoconical configuration of the nozzle annular seat 100 has the same angle as the angle of the adjacent surface of the valve flange dovetail configuration.

The other (outer) surface of the valve flange 140 is clamped by the retention cap 80 (FIGS. 9 and 10). The retention cap 80 defines a central opening 150 (FIGS. 6 and 10) surrounded by an annular clamping surface 152 (FIGS. 6 and 10) for engaging the outer surface of the valve flange 140 at an angle which matches the angle of the outer surface of the valve flange dovetail configuration (FIG. 6).

The retention cap 80 includes a skirt 156 (FIG. 6), the lower portion of which has an inwardly projecting bead 158 (FIG. 6) for snap-fit engagement with the bead 102 of the nozzle 60 (FIGS. 4 and 6) to clamp the valve 70 tightly in the nozzle assembly. This arrangement securely clamps and holds the valve 70 without requiring special internal support structures or bearing members adjacent the interior surface of the valve cylindrical sleeve 134. This permits the region adjacent the interior surface of the valve cylindrical sleeve 134 to be substantially open, free, and clear so as to accommodate movement of the valve sleeve 134 as described hereinafter.

The valve 70 is a resiliently flexible, molded structure which is preferably molded from a thermosetting elastomeric material, such as silicone rubber, natural rubber, and the like. The valve 70 could also be molded from a thermoplastic elastomer. Preferably, the valve 70 is molded from silicone rubber, such as the silicone rubber sold by The Dow Chemical Company in the United States of America under the trade designation DC-595.

The valve 70 could be molded with the slits 132. Alternatively, the valve slits 132 could be subsequently cut into the central head portion 130 of the valve 70 by suitable conventional techniques.

When the valve 70 is properly mounted within the nozzle assembly as illustrated in FIGS. 4 and 10, the central head portion 130 of the valve 70 lies recessed within the nozzle 60. However, when the package is squeezed to dispense the contents through the valve 70, then the valve head portion 130 is forced outwardly from its recessed position toward the end of the package and through the distal opening 150 (FIGS. 10 and 11).

The nozzle assembly (i.e., the nozzle 60, valve 70, and cap 80) is adapted to be mounted on the spout 38 as shown in FIG. 4. The nozzle bead 92 and spout bead 57 have profiles which accommodate movement of the beads past each other as the spout and nozzle are assembled by being forced together. The nozzle 60 undergoes some temporary outward expansion or deformation so that the beads slide past each other. The nozzle threads 84 can then be screwed onto the spout threads 58.

When the components are fully assembled and in the retracted, closed position as shown in FIG. 4, the nozzle dispensing passage 86 extends around at least a portion of the spout 38. The nozzle proximal seal surface bead 92 sealingly engages the spout proximal seal surface 56. The spout proximal seal surface bead 57 sealingly engages the nozzle proximal seal surface 90. The nozzle distal seal surface 96 sealingly engages the spout distal seal surface 54. This occludes the spout discharge apertures 46 and prevents flow out of the spout 38.

In order to dispense product, the nozzle 60 is rotated on the spout 38 to move the nozzle to the elevated, open position as shown in FIGS. 7–11. Then the package is inverted and squeezed. FIG. 10 shows orientation of a valve 70 when the package is first inverted before the container is squeezed. The container is then squeezed to increase the pressure within the container above the ambient exterior atmospheric pressure. This forces the product from the container toward the valve 70 and forces the valve 70 from the recessed or retracted position (FIG. 10) toward an outwardly extending position (shown in FIG. 11). The outward displacement of the central head portion 130 of the valve 70 is accommodated by the relatively thin, flexible sleeve 134. The sleeve 134 moves from an inwardly projecting, rest position (shown in FIG. 10) to an outwardly displaced, pressurized position, and this occurs by the sleeve 134 "rolling" along itself outwardly toward the outside end of the package (toward the position shown in solid lines in FIG. 11). However, the valve 70 does not open (i.e., the slits 132 do not open) until the valve central head portion 130 has moved substantially all the way to a fully extended position (FIG. 11). Indeed, as the valve head portion 130 begins to move outwardly, the valve head portion 130 is initially subjected to radially inwardly directed compression forces which tend to further resist opening of the slits 132. Also, the valve central head portion 130 generally retains its inwardly concave configuration as it moves outwardly and even after it reaches the fully extended position. However, if the internal pressure becomes sufficiently high after the valve central head portion 130 has moved outwardly to the fully extended position, then the slits 132 of the valve 70 open to dispense the fluent material (FIG. 11). The fluent material is then expelled or discharged through the open slits 132. For illustrative purposes, FIG. 11 shows a drop 160 of a liquid material being discharged.

Owing to the unique design, the dispensing of the fluent material from the nozzle assembly can be readily and accurately directed and controlled. The fluent material can be easily observed as it is discharged to a desired target area.

When the squeezing pressure on the container 30 is released, the valve 70 closes, and the valve head 130 retracts to its recessed, rest position within the nozzle 60. If the container is not being squeezed, the weight of the fluent material on the valve 70 does not cause the valve 70 to open, or to remain open. In some alternate valve designs, once the valve 70 opens, the valve 70 need not close, and may remain open, even after squeezing pressure is terminated.

The above-discussed dispensing action of valve 70 typically would occur only after (1) the system nozzle 60 has been moved to the open position (FIGS. 7–11), (2) the package has been inverted, and (3) the container is squeezed. Pressure on the interior side of the valve 70 will cause the valve to open when the differential between the interior and exterior pressure reaches a predetermined amount. Depending on the particular valve design, the open valve 70 may close when the pressure differential decreases, or the valve may stay open even if the pressure differential decreases to zero. In the preferred embodiment of the valve 70 illustrated for the first embodiment of the system shown in FIGS. 1–11, the valve is designed to close when the pressure differential decreases to a predetermined amount.

The nozzle assembly is prevented from being rotated beyond the full open condition (FIG. 9) and off of the spout 38 because of engagement of the nozzle bead 92 with the spout bead 57 (FIG. 9). However, in all positions of the nozzle 60, from fully closed (FIG. 4) to fully open (FIG. 9), the nozzle proximal seal surface bead 92 sealingly engages the spout proximal seal surface 56 while the spout proximal seal surface bead 57 sealingly engages the nozzle proximal seal surface 90. In all positions, the valve 70 remains located distally of the spout disk seal surface 54 and discharge apertures 46.

OTHER ILLUSTRATED EMBODIMENTS

Figure 15:
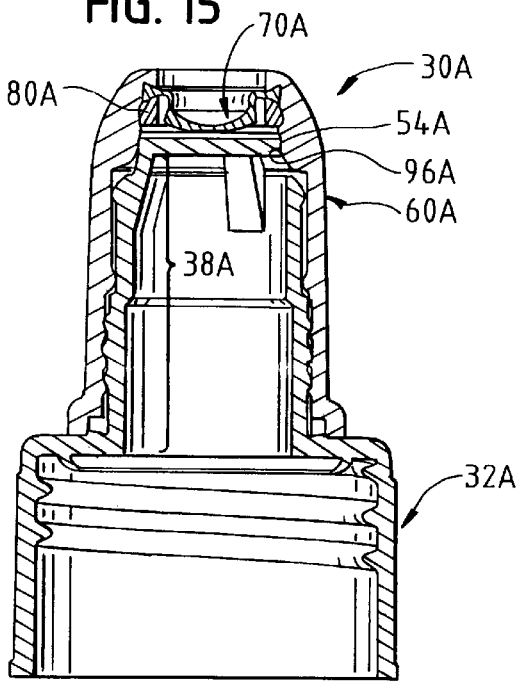
FIG. 15 is a cross-sectional view taken generally along the plane 15—15 in FIG. 14.
Figure 16:
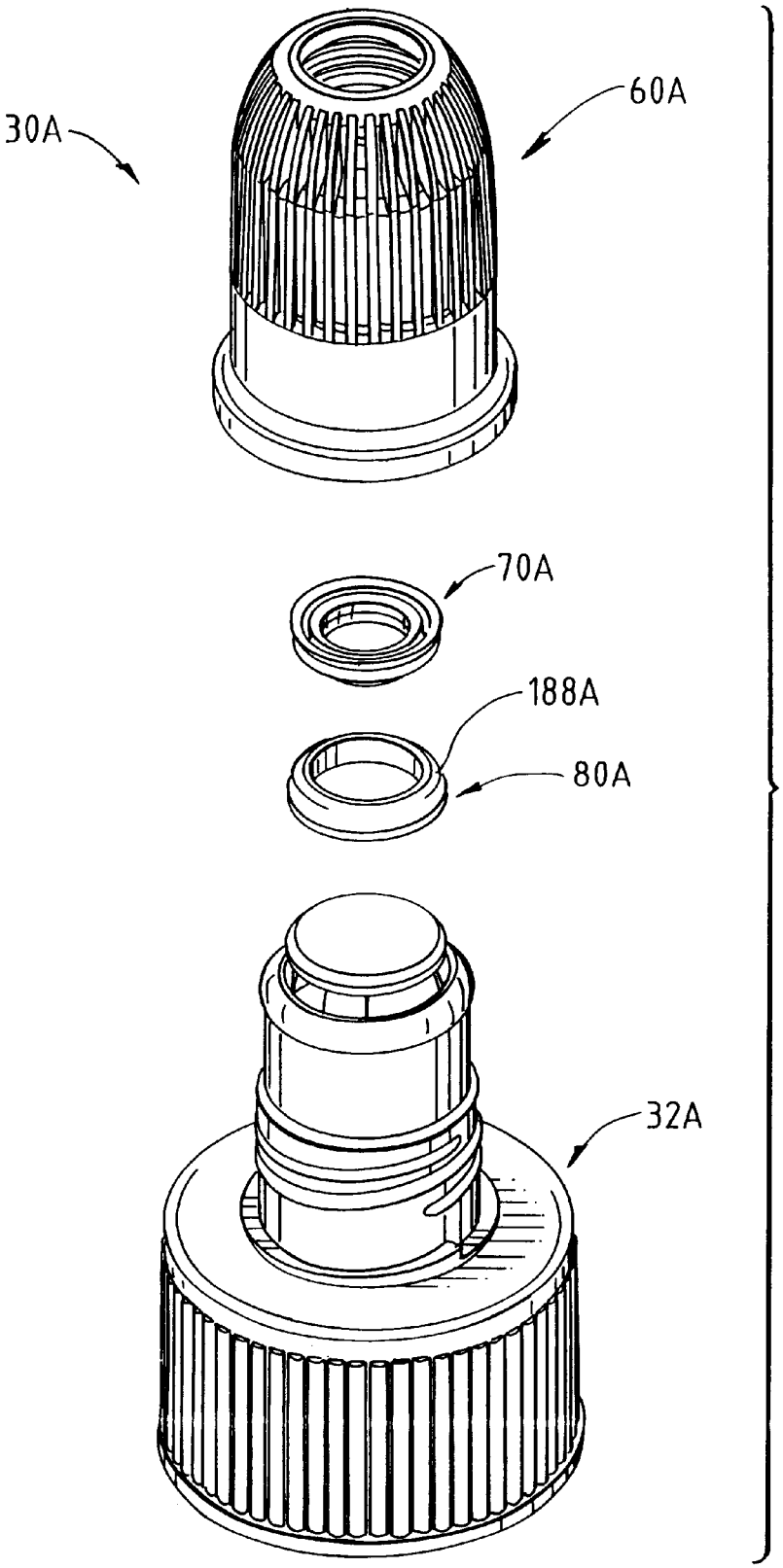
FIG. 16 is an exploded, perspective view of the second embodiment of the dispensing closure.
Figure 17:
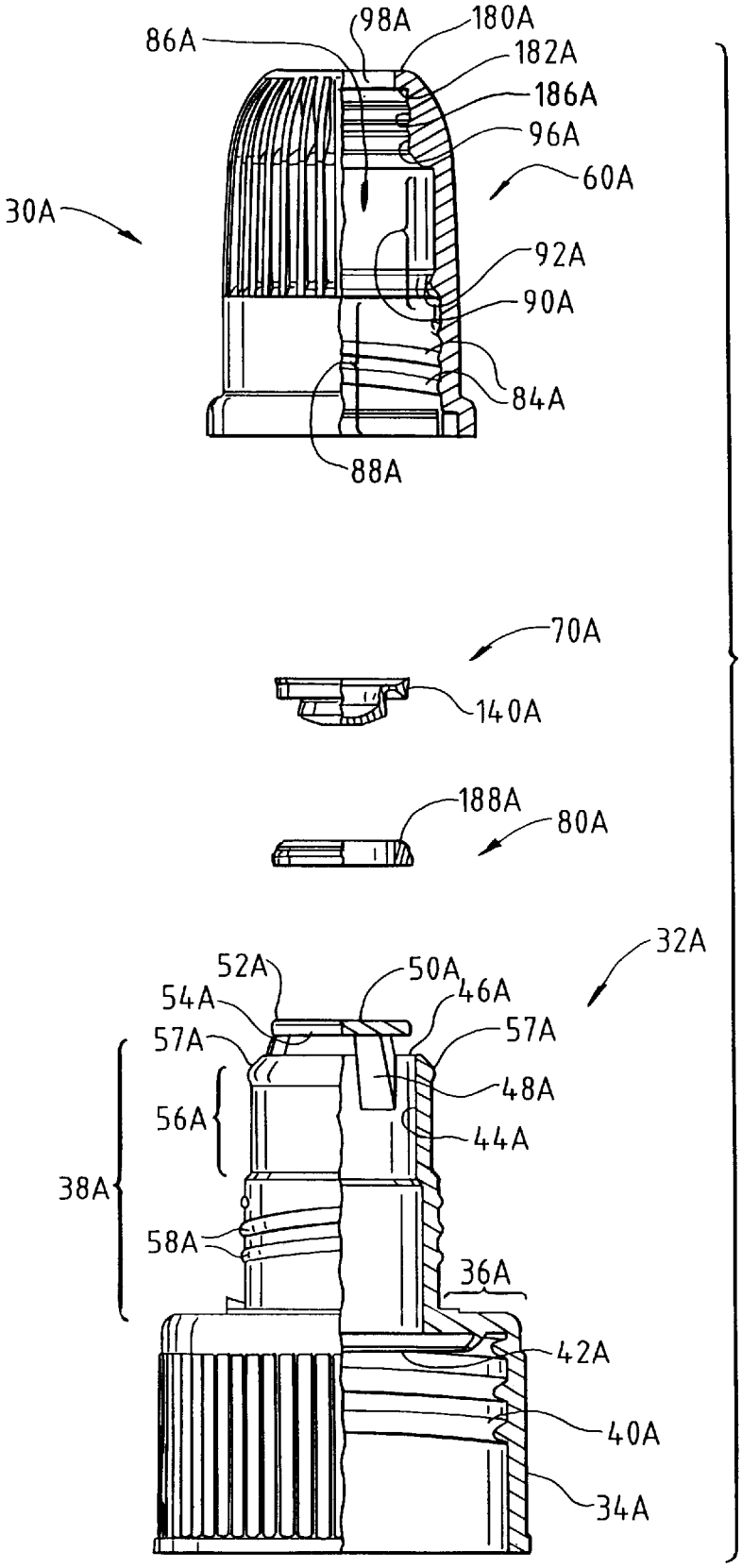
FIG. 17 is an exploded, partial cross-sectional view of the second embodiment of the dispensing closure of the present invention.

FIGS. 12–20 illustrate a second embodiment of the dispensing system of the present invention in the form of a dispensing closure 30A. As can be seen in FIG. 16, the second embodiment closure 30A includes a base or body 32A, a nozzle 60A adapted to be mounted to the body 32A, a valve 70A for being received in the nozzle 60A, and a retainer 80A in the form of an annular ring for holding the valve 70A in the nozzle 60A. The second embodiment body 32A is substantially similar to the first embodiment body 32 described above with reference to FIGS. 1–11. As can be seen in FIG. 17, the body 32A includes a skirt 34A, shoulder 36A, spout 38A, internal thread 40A for engaging a container thread, crab's claw seal 42A for sealing against the top edge of the container, internal discharge passage 44A, three discharge apertures 46A, three struts 48A, disk 50A, surface 52A, distal seal surface 54A, proximal seal surface 56A, proximal seal bead 57A, and external thread 58A for threadingly engaging the nozzle 60A.

The second embodiment valve 70A is identical with the first embodiment valve 70 described above with reference to FIGS. 1–11. The valve 70A includes a mounting flange 140A which has a dovetail-shaped cross section.

As can be seen in FIG. 17, the second embodiment nozzle 60A includes an internal dispensing passage 86A with an internal thread 84A in a larger diameter lower portion 88A for engaging the spout external thread 58A, a proximal seal surface 90A, an annular seal bead 92A, and a distal seal surface 96A which is adapted to seal against the closure body spout distal seal surface 54A when the nozzle 60A is in the fully closed, retracted position on the spout 38A (FIG. 15). The nozzle dispensing passage 86A terminates in a dispensing opening 98A at the upper, distal end of the nozzle 60A.

The distal end of the nozzle 60A has a radially inwardly directed flange 180A which defines the opening 98A and which has a lower, annular, clamping surface or seat 182A for engaging the upper surface of the flange 140A of the valve 70A. The flange 140A has a generally dove tail-shaped, transverse cross section (as viewed in FIG. 17). The clamping surface 182A of the nozzle flange 180A has a generally frustoconical configuration forming the same angle as the angle of the adjacent surface of the flange 140A of the valve 70A.

The valve 70A is held within the nozzle 60A against the nozzle flange clamping surface 182A by the annular ring retainer 80A. The upper end of the nozzle 60A includes a shallow, internal, annular channel 186A (FIG. 17) for receiving a peripheral portion of the retainer 80A in a snap-fit engagement (as can be seen in FIG. 15) to securely clamp the valve 70A within the nozzle 60A. The upper surface of the retainer 80A has a frustoconical surface 188A which generally corresponds to the angle of the frustoconical surface of the lower surface of the flange 140A of the valve 70A.

The second embodiment of the dispensing system 30A operates in substantially the same way as the first embodiment of the dispensing system 30 described above with reference to FIGS. 1–11. In the second embodiment dispensing system 30A, the nozzle 60A is adapted to be threadingly engaged with the body spout 38A (FIG. 15) and rotated downwardly to the lowermost, fully retracted, fully closed position wherein the flow path through the dispensing system is occluded because of the engagement of the spout disk distal seal surface 54A with the nozzle distal seal surface 96A. This prevents flow from the container through the valve 70A which is located at all times distally of the spout 38A.

Figure 18:
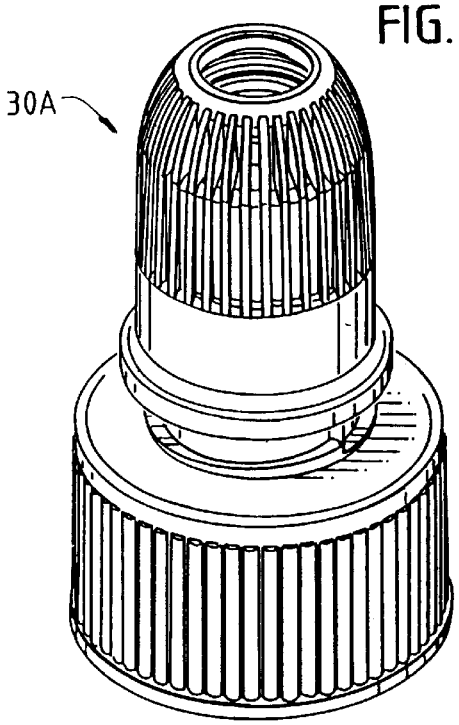
FIG. 18 is a view similar to FIG. 12, but FIG. 18 shows the second embodiment of the dispensing closure in fully opened condition.
Figure 19:
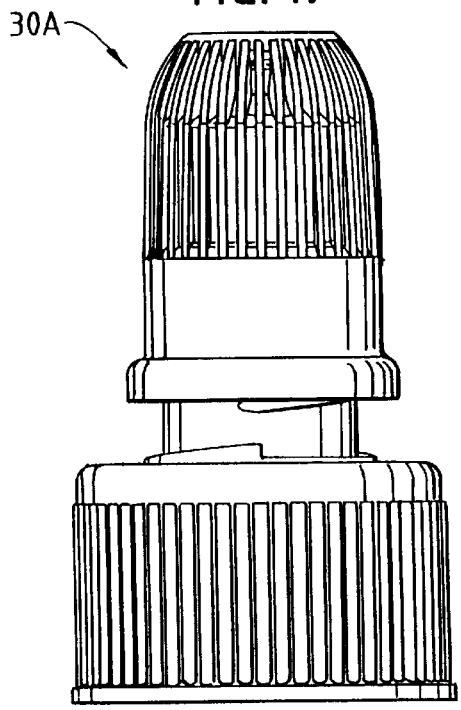
FIG. 19 is a view similar to FIG. 13, but FIG. 19 shows the second embodiment of the dispensing closure in a fully opened condition.
Figure 20:
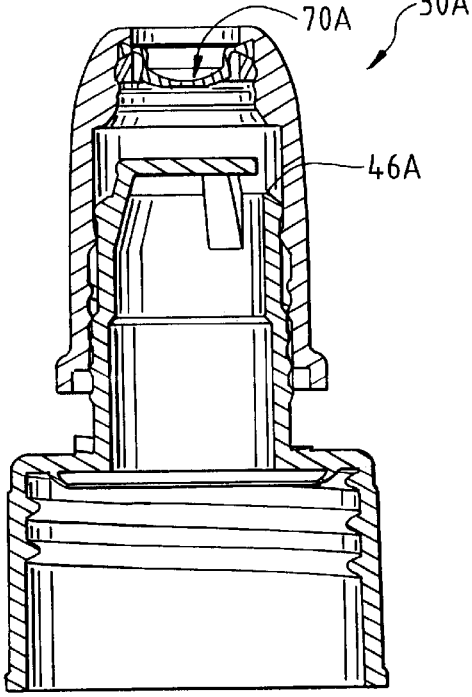
FIG. 20 is a view similar to FIG. 15, but FIG. 20 shows the second embodiment of the dispensing closure in a fully opened condition.

When it is desired to dispense fluid material, the nozzle 60A is rotated on the spout 38A to the fully extended, fully open, position as shown in FIGS. 18–20 wherein the discharge apertures 46A are open and accommodate flow from the container through the valve 70A when the container is subjected to sufficient internal pressure to open the valve 70A. At all times, the nozzle proximal seal surface bead 92A sealingly engages the spout proximal seal surface 56A while the spout proximal seal surface bead 57A sealingly engages the nozzle proximal seal surface 90A. The nozzle 60A is prevented from being rotated off the upper end of the spout 38A because of engagement of the nozzle bead 92A with the spout bead 57A.

Figure 21:
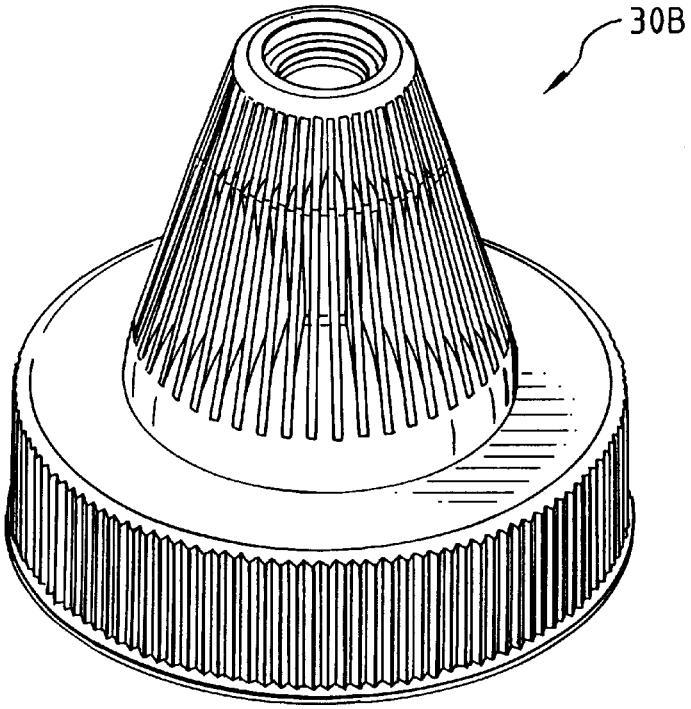
FIG. 21 is a perspective view of a third embodiment of the dispensing system of the present invention incorporated in a dispensing closure which is formed separately from, and which is adapted to be releasably mounted to, a container which has an opening to the container interior, and the dispensing closure is shown with the components in a closed condition.
Figure 22:
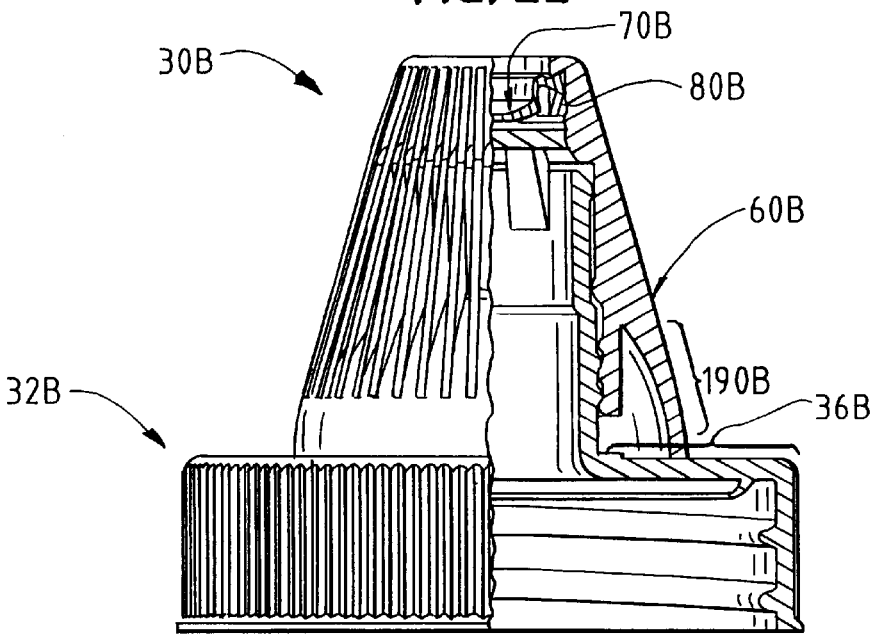
FIG. 22 is a partial cross-sectional view of the third embodiment of the dispensing closure illustrated in FIG. 21.

FIGS. 21 and 22 illustrate a third embodiment of the dispensing system of the present invention in the form of a dispensing closure 30B. The third embodiment dispensing closure 30B is similar to the second embodiment 30A described above with reference to FIGS. 12–20. The third embodiment dispensing closure 30B has a closure body 32B which is similar to the second embodiment closure body 32A except that the third embodiment closure body 32B has a larger diameter shoulder 36B.

The third embodiment dispensing system includes a nozzle 60B which is similar to the second embodiment nozzle 60A described above with reference to FIGS. 12–20. However, the third embodiment nozzle 60B has a generally frustoconical exterior shape with a downwardly extending, outer housing wall 190B (FIG. 22). The internal structures of the closure body 32B and nozzle 60B are substantially identical with the internal structures of the second embodiment closure body 32A and second embodiment nozzle 60A, respectively.

The third embodiment includes a valve 70B mounted within the nozzle 60B and retained therein by means of an annular retainer 80B. The valve 70B and retainer 80B are identical with the second embodiment valve 70A and second embodiment retainer 80A, respectively.

The third embodiment of the dispensing system 30B operates in the same way as the second embodiment of the dispensing system 30A described above.

Figure 23:
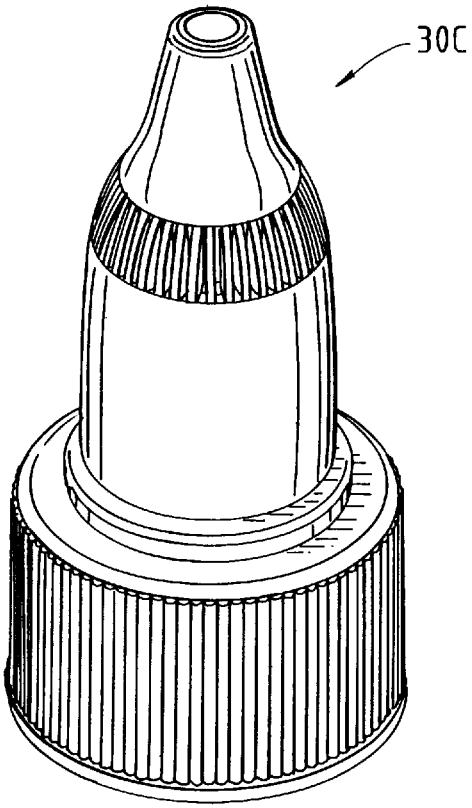
FIG. 23 is a perspective view of a fourth embodiment of the dispensing system of the present invention incorporated in a dispensing closure which is formed separately from, and which is adapted to be releasably mounted to, a container which has an opening to the container interior, and the dispensing closure is shown with the components in a closed condition.
Figure 24:
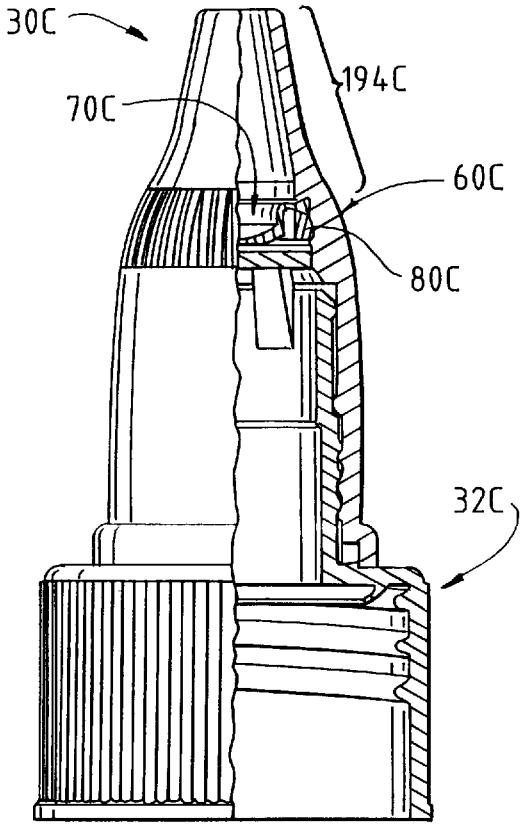
FIG. 24 is a partial cross-sectional view of the fourth embodiment of the dispensing closure shown in FIG. 23.

A fourth embodiment of the dispensing system of the present invention in the form of a dispensing closure 30C is illustrated in FIGS. 23 and 24. The fourth embodiment dispensing closure 30C is similar to the second embodiment dispensing closure dispensing closure 30A described above with reference to FIGS. 12–20. The fourth embodiment dispensing closure 30C includes a closure body 32C which is substantially identical with the second embodiment closure body 32A. Mounted on the closure body 32C is a nozzle 60C. The nozzle 60C is substantially identical with the second embodiment nozzle 60A except that the fourth embodiment nozzle 60C has a longer discharge end 194C (FIG. 24). Mounted within the nozzle 60C is a valve 70C which is retained therein by an annular retainer 80C.

The valve 70C and retainer 80C are identical with the second embodiment valve 70A and second embodiment retainer 80A.

The fourth embodiment of the dispensing system 30C operates in substantially the same way as the second embodiment dispensing system 30A described above with reference to FIGS. 12–20.

OTHER MODIFICATIONS

The valve (e.g., valve 70) may have a shape or configuration that differs from the shape or configuration illustrated in the Figures. Further, the valve need not have a slit or slits per se. Rather, the valve could have some other discontinuity or feature defining a normally closed dispensing orifice.

The spout (e.g., spout 38) and nozzle (e.g., nozzle 60) need not be threadingly engaged as illustrated with threads (e.g., threads 58 and 84 in FIGS. 4 and 6). Rather, the threads may be omitted from both the spout and nozzle. The nozzle could instead be slidably disposed on the spout for vertical movement along the spout. The user would merely pull the nozzle up (i.e., outwardly) to open the closure, and the user would merely push the nozzle down (i.e., inwardly) to close the closure.

If desired, the nozzle assembly may be provided with an attached, or completely removable, lid (not illustrated) to protect the valve 70 against damage and/or to keep out dust and dirt. Such a lid may be hinged to the nozzle assembly with a conventional or special snap-action hinge, or the lid may simply be tethered to the nozzle assembly. The lid may also include an inwardly extending plug or member for being received in the concave region of the valve 70 as a means for further sealing the valve 70 during shipping and handling when the package could be subjected to exterior forces that could cause internal, transient pressure increases that might otherwise open the valve.

In still another contemplated modification, a releasable liner or removable label (not illustrated) could be initially attached across the top of the nozzle assembly. After such a removable liner has been removed by the user, it could be saved by the user and later re-applied to the top of the closure (e.g., when the user subsequently wants to stow the package in luggage while traveling). This would prevent damage to the valve and/or prevent ingress of dust and dirt.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing system for dispensing a product from a container having an opening, said system comprising:

a body for projecting outwardly from said container and having a spout that terminates in a distal end and that defines (1) a discharge passage for communicating with said container opening, (2) at least one discharge aperture opening externally from said spout discharge passage and having a fixed geometry at a stationary location relative to said container, (3) a distal seal surface located distally of said discharge aperture relative to said container, and (4) a proximal seal surface located on the exterior of said spout proximally of said discharge aperture; and a nozzle assembly which is mounted on said spout over said spout distal end for movement between a retracted, closed position and an extended, open position, and which includes (1) a nozzle, and (2) a valve carried by said nozzle, said nozzle having (a) a dispensing passage for communicating with said spout discharge aperture at least when said nozzle assembly is moved away from said retracted, closed position, (b) a proximal seal surface for sealingly engaging said spout proximal seal surface, and (c) a distal seal surface located outwardly of said nozzle proximal seal surface for sealingly engaging said spout distal seal surface when said nozzle assembly is in said retracted, closed position to prevent flow through said nozzle dispensing passage to said valve, said valve being a resiliently flexible valve sealingly disposed across said nozzle dispensing passage at a location distally of said spout distal seal surface when said nozzle assembly is in said retracted, closed position as well as when said nozzle assembly is in said extended, open position, and said valve having an initially closed dispensing orifice which opens in response to a differential between the pressure acting against the side of the closed valve exposed to ambient atmosphere and the pressure acting against the side of the closed valve exposed to the container opening.

2. The dispensing system accordance with claim 1 in which said valve is a self-closing valve.

3. The dispensing system in accordance with claim 2 in which said valve opens outwardly when the pressure against the side of the valve exposed to the container opening exceeds the pressure acting against the side of the valve exposed to ambient atmosphere by a predetermined amount; and said valve returns from an open condition to a closed condition after the pressure acting on the side of the valve exposed to the container opening decreases.

4. The dispensing system in accordance with claim 1 in which said system is a dispensing closure that is separate from, but releasably attachable to, said container around said container opening.

5. The dispensing system in accordance with claim 4 in which said system includes said container;

said container has an external, male thread; and said body has an internal, female thread for threadingly engaging said male thread on said container.

6. The dispensing system in accordance with claim 1 in which said valve has an annular flange;

said nozzle has a distal end with a radially inwardly directed flange defining an annular seat facing the interior of said nozzle; and said nozzle assembly includes a retainer engaged with said nozzle to retain said valve in said nozzle with said valve annular flange clamped by said retainer against said nozzle annular seat.

7. The dispensing system in accordance with claim 6 in which said retainer is a generally annular ring which is in a snap-fit engagement with said nozzle.

8. The dispensing system in accordance with claim 7 in which said nozzle includes an internal, annular channel; and said retainer includes a peripheral portion adapted to be received in said channel in a snap-fit engagement.

9. The dispensing system in accordance with claim 7 in which said valve annular flange has a dovetail cross section defining a frustoconical outer surface and a frustoconical inner surface;

said nozzle has a central opening surrounded by said nozzle annular seat;

said nozzle annular seat is a frustoconical seat engaging said frustoconical outer surface of said valve annular flange; and said retainer has a frustoconical clamping surface engaging said frustoconical inner surface of said valve annular flange to clamp said valve annular flange between said retainer and said nozzle annular seat.

10. The dispensing system in accordance with claim 1 in which said valve is molded from a thermosetting elastomer.

11. The dispensing system in accordance with claim 1 in which said valve has an annular flange with an outer periphery defining a generally cylindrical outer surface.

12. The dispensing system in accordance with claim 1 in which said body includes a hollow, generally cylindrical base adapted to be mounted on said container; and said spout extends from said base;

said spout has a length and has a generally circular, transverse cross section everywhere along its length; and said base has a diameter which is greater than the diameter of said spout everywhere along the length of said spout.

13. The dispensing system in accordance with claim 1 in which said nozzle proximal seal surface includes (1) a generally cylindrical seal surface, and (2) a radially inwardly projecting seal bead adjacent, and merging with, said nozzle cylindrical seal surface; and said spout proximal seal surface includes (1) a radially outwardly projecting seal bead, and (2) a generally cylindrical seal surface adjacent, and merging with, said spout seal bead.

14. The dispensing system in accordance with claim 1 in which said spout has a distal end that includes a disk located distally of said discharge aperture;

said disk has an arcuate, peripheral, distal edge merging with a generally cylindrical, peripheral surface which defines said spout distal seal surface; and a portion of said nozzle between said valve and said nozzle proximal seal surface has a generally cylindrical interior surface which defines said nozzle distal seal surface for sealingly engaging said spout disk peripheral surface.

15. The dispensing system in accordance with claim 1 in which said spout discharge aperture is one of a plurality of identical discharge apertures that are radially oriented.

16. A dispensing system for dispensing a product from a container having an opening, said system comprising:

a body for projecting outwardly from said container and having a spout that terminates in a distal end and that defines (1) a discharge passage for communicating with said container opening, (2) at least one discharge aperture opening externally from said spout discharge passage, (3) a distal seal surface located distally of said discharge aperture, and (4) a proximal seal surface located on the exterior of said spout proximally of said discharge aperture; and a nozzle assembly which is mounted on said spout over said spout distal end for movement between a retracted, closed position and an extended, open position, and which includes (1) a nozzle, and (2) a valve carried by said nozzle, said nozzle having (a) a dispensing passage for communicating with said spout discharge aperture at least when said nozzle assembly is moved away from said retracted, closed position, (b) a proximal seal surface for sealingly engaging said spout proximal seal surface, and (c) a distal seal surface located outwardly of said nozzle proximal seal surface for sealingly engaging said spout distal seal surface when said nozzle assembly is in said retracted, closed position to prevent flow through said nozzle dispensing passage to said valve, said valve being a resiliently flexible valve sealingly disposed across said nozzle dispensing passage at a location distally of said spout distal seal surface when said nozzle assembly is in said retracted, closed position as well as when said nozzle assembly is in said extended, open position, and said valve having an initially closed dispensing orifice which opens in response to a differential between the pressure acting against the side of the closed valve exposed to ambient atmosphere and the pressure acting against the side of the closed valve exposed to the container opening;

said valve having an annular flange defining an outer surface and an inner surface;

said nozzle having a distal end;

said nozzle dispensing passage terminating in a dispensing opening at said nozzle distal end;

said nozzle defining an annular seat around said nozzle dispensing opening for engaging said valve flange inner surface;

said nozzle assembly including an annular retention cap in a snap-fit engagement with said nozzle at the distal end of said nozzle; and said retention cap defining a central opening surrounded by an annular flange defining an annular clamping surface for engaging said valve flange outer surface to clamp said valve flange between said retention cap and said nozzle.

17. The dispensing system in accordance with claim 6 in which said valve flange has a dovetail cross section;

said valve flange outer surface and inner surface are each frustoconical; and said retention cap flange annular clamping surface and said nozzle annular seat are each frustoconical.

18. A dispensing system for dispensing a product from a container having an opening, said system comprising:

a body for projecting outwardly from said container and having a spout that terminates in a distal end and that defines (1) a discharge passage for communicating with said container opening, (2) at least one discharge aperture opening externally from said spout discharge passage, (3) a distal seal surface located distally of said discharge aperture, and (4) a proximal seal surface located on the exterior of said spout proximally of said discharge aperture; and a nozzle assembly which is mounted on said spout over said spout distal end for movement between a retracted, closed position and an extended, open position, and which includes (1) a nozzle, and (2) a valve carried by said nozzle, said nozzle having (a) a dispensing passage for communicating with said spout discharge aperture at least when said nozzle assembly is moved away from said retracted, closed position, (b) a proximal seal surface for sealingly engaging said spout proximal seal surface, and (c) a distal seal surface located outwardly of said nozzle proximal seal surface for sealingly engaging said spout distal seal surface when said nozzle assembly is in said retracted, closed position to prevent flow through said nozzle dispensing passage to said valve, said valve being a resiliently flexible valve sealingly disposed across said nozzle dispensing passage at a location distally of said spout distal seal surface when said nozzle assembly is in said retracted, closed position as well as when said nozzle assembly is in said extended, open position, and said valve having an initially closed dispensing orifice which opens in response to a differential between the pressure acting against the side of the closed valve exposed to ambient atmosphere and the pressure acting against the side of the closed valve exposed to the container opening;

said spout having an external, male thread inwardly of said spout proximal seal surface; and said nozzle having an internal, female thread inwardly of said nozzle proximal seal surface for engaging said spout external, male thread.

19. A dispensing system for dispensing a product from a container having an opening, said system comprising:

a spout for communicating with said container opening and defining (1) at least one discharge aperture having a fixed geometry at a stationary location relative to said container, (2) a distal seal surface located distally of said discharge aperture relative to said container, and (3) a proximal seal surface located on the exterior of said spout proximally of said discharge aperture; and a nozzle assembly which is mounted on said spout for movement between a retracted, closed position and an extended, open position, and which includes (A) a nozzle having (1) a dispensing passage around at least a portion of said spout, (2) a proximal seal surface for sealingly engaging said spout proximal seal surface, and (3) a distal seal surface located outwardly of said nozzle proximal seal surface for sealingly engaging said spout distal seal surface when said nozzle assembly is in said retracted, closed position, and (B) a resiliently flexible valve that (1) is sealingly disposed across said nozzle dispensing passage at a location distally of said spout distal seal surface, and (2) has an initially closed dispensing orifice which opens in response to a pressure differential acting across said valve.

20. The dispensing system in accordance with claim 19 in which said nozzle dispensing passage is defined at least in part by said nozzle distal seal surface and said nozzle proximal seal surface.

21. The dispensing system in accordance with claim 19 in which said system includes a hollow base for mounting to said container over said container opening; and said spout extends from said base.

22. The dispensing system in accordance with claim 19 in which said spout defines an internal discharge passage which communicates with said container opening and with said spout discharge aperture.

23. The dispensing system in accordance with claim 19 in which said spout has a distal end defining said spout distal seal surface; and said spout discharge aperture is adjacent said spout distal end.

24. The dispensing system in accordance with claim 19 in which said nozzle dispensing passage, said nozzle distal seal surface, and said spout distal seal surface are configured relative to said spout discharge aperture so as to establish communication between said valve and said spout discharge aperture only when said nozzle assembly is moved away from said retracted, closed position.

25. The dispensing system accordance with claim 19 in which said valve is a self-closing valve.

26. The dispensing system in accordance with claim 25 in which said valve opens outwardly when the pressure against the side of the valve exposed to the container opening exceeds the pressure acting against the side of the valve exposed to ambient atmosphere by a predetermined amount; and said valve returns from an open condition to a closed condition after the pressure acting on the side of the valve exposed to the container opening decreases.

27. The dispensing system in accordance with claim 19 in which said system is a dispensing closure that is separate from, but releasably attachable to, said container around said container opening.

28. The dispensing system in accordance with claim 27 in which said system includes said container;

said container has an external, male thread;

said system includes a body having a hollow, generally cylindrical base which has an internal, female thread for threadingly engaging said male thread on said container; and said spout extends from said hollow base.

29. The dispensing system in accordance with claim 19 in which said valve has an annular flange;

said nozzle has a distal end with a radially inwardly directed flange defining an annular seat facing the interior of said nozzle; and said nozzle assembly includes a retainer engaged with said nozzle to retain said valve in said nozzle with said valve annular flange clamped by said retainer against said nozzle annular seat.

30. The dispensing system in accordance with claim 29 in which said retainer is a generally annular ring which is in a snap-fit engagement with said nozzle.

31. The dispensing system in accordance with claim 30 in which said nozzle includes an internal, annular channel; and said retainer includes a peripheral portion adapted to be received in said channel in a snap-fit engagement.

32. The dispensing system in accordance with claim 30 in which said valve annular flange has a dovetail cross section defining a frustoconical outer surface and a frustoconical inner surface;

said nozzle has a central opening surrounded by said nozzle annular seat;

said nozzle annular seat is a frustoconical seat engaging said frustoconical outer surface of said valve annular flange; and said retainer has a frustoconical clamping surface engaging said frustoconical inner surface of said valve annular flange to clamp said valve annular flange between said retainer and said nozzle annular seat.

33. The dispensing system in accordance with claim 19 in which said valve is molded from a thermosetting elastomer.

34. The dispensing system in accordance with claim 19 in which said valve has an annular flange with an outer periphery defining a generally cylindrical outer surface.

35. The dispensing system in accordance with claim 19 in which said nozzle proximal seal surface includes (1) a generally cylindrical seal surface, and (2) a radially inwardly projecting seal bead adjacent, and merging with, said nozzle cylindrical seal surface; and said spout proximal seal surface includes (1) a radially outwardly projecting seal bead, and (2) a generally cylindrical seal surface adjacent, and merging with, said spout seal bead.

36. The dispensing system in accordance with claim 19 in which said spout has a distal end that includes a disk located distally of said discharge aperture;

said disk has an arcuate, peripheral, distal edge merging with a generally cylindrical, peripheral surface which defines said spout distal seal surface; and a portion of said nozzle between said valve and said nozzle proximal seal surface has a generally cylindrical interior surface which defines said nozzle distal seal surface for sealingly engaging said spout disk peripheral surface.

37. The dispensing system in accordance with claim 19 in which said spout discharge aperture is one of a plurality of identical discharge apertures that are radially oriented.

38. A dispensing system for dispensing a product from a container having an opening, said system comprising:

a spout for communicating with said container opening and defining (1) at least one discharge aperture, (2) a distal seal surface located distally of said discharge aperture, and (3) a proximal seal surface located on the exterior of said spout proximally of said discharge aperture; and a nozzle assembly which is mounted on said spout for movement between a retracted, closed position and an extended, open position, and which includes (A) a nozzle having (1) a dispensing passage around at least a portion of said spout, (2) a proximal seal surface for sealingly engaging said spout proximal seal surface, and (3) a distal seal surface located outwardly of said nozzle proximal seal surface for sealingly engaging said spout distal seal surface when said nozzle assembly is in said retracted, closed position, and (B) a resiliently flexible valve that (1) is sealingly disposed across said nozzle dispensing passage at a location distally of said spout distal seal surface, and (2) has an initially closed dispensing orifice which opens in response to a pressure differential acting across said valve;

said valve having an annular flange defining an outer surface and an inner surface;

said nozzle having a distal end;

said nozzle dispensing passage terminating in a dispensing opening at said nozzle distal end;

said nozzle defining an annular seat around said nozzle dispensing opening for engaging said valve flange inner surface;

said nozzle assembly including an annular retention cap in a snap-fit engagement with said nozzle at the distal end of said nozzle; and said retention cap defining a central opening surrounded by an annular flange defining an annular clamping surface for engaging said valve flange outer surface to clamp said valve flange between said retention cap and said nozzle.

39. The dispensing system in accordance with claim 38 in which said valve flange has a dovetail cross section;

said valve flange outer surface and inner surface are each frustoconical; and said retention cap flange annular clamping surface and said nozzle annular seat are each frustoconical.

40. A dispensing system for dispensing a product from a container having an opening, said system comprising:

a spout for communicating with said container opening and defining (1) at least one discharge aperture, (2) a distal seal surface located distally of said discharge aperture, and (3) a proximal seal surface located on the exterior of said spout proximally of said discharge aperture; and a nozzle assembly which is mounted on said spout for movement between a retracted, closed position and an extended, open position, and which includes (A) a nozzle having (1) a dispensing passage around at least a portion of said spout, (2) a proximal seal surface for sealingly engaging said spout proximal seal surface, and (3) a distal seal surface located outwardly of said nozzle proximal seal surface for sealingly engaging said spout distal seal surface when said nozzle assembly is in said retracted, closed position, and (B) a resiliently flexible valve that (1) is sealingly disposed across said nozzle dispensing passage at a location distally of said spout distal seal surface, and (2) has an initially closed dispensing orifice which opens in response to a pressure differential acting across said valve;

said spout having an external, male thread inwardly of said spout proximal seal surface; and said nozzle having an internal, female thread inwardly of said nozzle proximal seal surface for engaging said spout external, male thread.

* * * * *